United States Patent [19]

Hiramatsu

[11] Patent Number: 4,701,593

[45] Date of Patent: Oct. 20, 1987

[54] THERMAL HEAD

[75] Inventor: Soichi Hiramatsu, Yokohama, Japan

[73] Assignee: Canon Kabushiki Kaisha, Tokyo, Japan

[21] Appl. No.: 862,154

[22] Filed: May 12, 1986

Related U.S. Application Data

[63] Continuation of Ser. No. 635,235, Jul. 27, 1984, abandoned.

[30] Foreign Application Priority Data

Aug. 5, 1983 [JP] Japan ..... 58-142564

[51] Int. Cl.[4] ..... B41J 3/20

[52] U.S. Cl. ..... 219/216; 346/76 PH

[58] Field of Search ..... 219/216 PH; 346/76 PH; 400/120; 428/542.8

[56] References Cited

U.S. PATENT DOCUMENTS

| | | | |
|---|---|---|---|
| 3,939,325 | 2/1976 | Otani | 219/216 PH |
| 4,367,395 | 1/1983 | Asakawa | 219/216 PH |
| 4,399,348 | 8/1983 | Bakewell | 219/216 PH |
| 4,630,073 | 12/1986 | Hashimoto | 346/76 PH |

FOREIGN PATENT DOCUMENTS

| | | | |
|---|---|---|---|
| 57-159668 | 10/1982 | Japan | 400/120 |
| 57-176182 | 10/1982 | Japan | 400/120 |

OTHER PUBLICATIONS

Cahill, J. G., "Print Head Structure", IBM Tech. Disc. Bull. vol. 22, No. 12, May 1980, p. 5506.

*Primary Examiner*—E. A. Goldberg
*Assistant Examiner*—Teresa J. Walberg
*Attorney, Agent, or Firm*—Fitzpatrick, Cella, Harper & Scinto

[57] ABSTRACT

A thermal head includes electrodes, a heat generating member connected to the electrodes and a heat generating member support having bevelled edges. The thermal head is manufactured by preparing the substrate having the heat generating members and the electrodes fixed thereon, forming grooves along cut lines of the substrate such that bevels are formed at edges of individual elements when the substrate is cut into the individual elements along the cut lines, and cutting the substrate along the cut lines.

14 Claims, 12 Drawing Figures

THERMAL HEAD

This application is a continuation of application Ser. No. 635,235 filed 7/27/84, now abandoned.

BACKGROUND OF THE INVENTION

1. Field of the Invention

The present invention relates to a thermal head and a manufacturing method thereof, and more particularly to a thermal head which does not scratch a print paper and assures a high print quality, and a manufacturing method thereof.

2. Description of The Prior Art

A structure of a prior art thermal head is shown in FIGS. 1 and 2.

In a usual thermal head 1, a glaze layer 6 which serves for heat insulation is formed on a ceramic substrate 2, and a heat generating resistor 3 and electrodes 4 are formed on the glaze layer 6 a protection layer 5 for preventing oxidization and abrasion are formed on the heat generating resistor 3 and the electrodes 4 to cover them.

As shown in FIG. 3, the ceramic substrate 2 having an area corresponding to a plurality of heads is prepared, on which the glaze layer 6, the heat generating resister 3 and the electrodes 4 are formed, and it is cut along cut lines 7 shown by broken lines into individual thermal heads 1.

When the thermal head thus constructed is used for printing, it scratches a thermal print paper or a thermal transfer ink ribbon because it has a sharp edge at the cut portion along the cut line 7, and hence print quality is deteriorated.

This is illustrated in FIG. 4, in which numeral 8 denotes a print paper which is scratched by an edge 9 of the thermal head 1. The thermal head 1 is usually mounted on a heat sink 10 as shown in FIG. 5. Accordingly, a side 9*a* of the thermal head 1 slightly protrudes from a top surface of the heat sink 10 as shown in FIG. 5. Thus, when the thermal head 1 is moved left beyond a side edge 11 of the second paper 8 and then moved reversely, the side 9*a* of the thermal head 1 scratches the side edge 11.

In order to prevent such scratch, the thermal head 1 may be constructed not to protrude from the surface of the heat sink 10. However, it is very difficult to design the thermal head 1 having non-protruding side 9*a* because of the precision with which an anti-scratch spacer must be arranged on the heat sink 10 or the thermal head 1.

SUMMARY OF THE INVENTION

It is an object of the present invention to provide a thermal head which prevents scratching of the print paper to assure a high print quality, and a manufacturing method thereof.

It is another object of the present invention to provide a method for manufacturing a thermal head comprising the steps of:

preparing a substrate member having at least two heat generating members and electrodes connected to the heat generating members fixed thereon;

forming grooves along cut lines on the substrate member such that bevels are formed at edges of individual elements when the substrate member is cut into the individual elements along the cut lines; and cutting the substrate member along the cut lines.

It is yet another object of the present invention to provide a thermal head comprising:

electrode means;

heat generating means connected to the electrode means; and heat generating means support means for supporting the heat generating means;

the heat generating means support means having bevels of edges thereof.

It is other object of the present invention to provide a thermal head comprising:

heat generating means;

electrode means connected to the heat generating means;

first support means for supporting the heat generating means and the electrode means; and second support means having a deeper recess than a height of the first support means;

the second support means supporting the first support means in the recess.

It is other object of the present invention to provide a thermal head comprising:

electrode means;

heat generating means connected to the electrode means; and support means for supporting the heat generating means;

the support means has a radius of curvature on a surface supporting the heat generating means.

It is still another object of the present invention to provide a method for manufacturing a thermal head comprising the steps of:

fixing at least two heat generating means and electrode means connected to the heat generating means to a substrate member; and dividing the substrate member into individual units each including heat generating means such that bevels are formed at edges of the individual units.

BRIEF DESCRIPTION OF THE DRAWINGS

FIGS. 6 and 7 show one embodiment of the present invention, in which FIG. 6 is a plan view of a thermal head and FIG. 7 is a plan view of the thermal head mounted on a heat sink.

DETAILED DESCRIPTION OF THE PREFERRED EMBODIMENTS

First Embodiment

Figure 1:
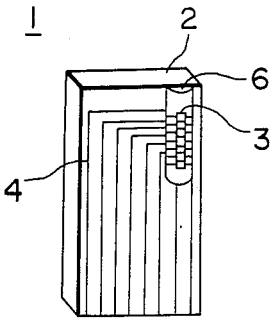
FIG. 1 PRIOR ART
FIGS. 1 and 2 are a perspective view and an enlarged sectional view of a prior art structure.
Figure 2:
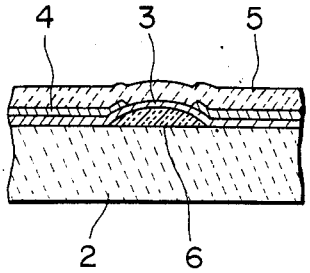
FIG. 2 PRIOR ART
Figure 3:
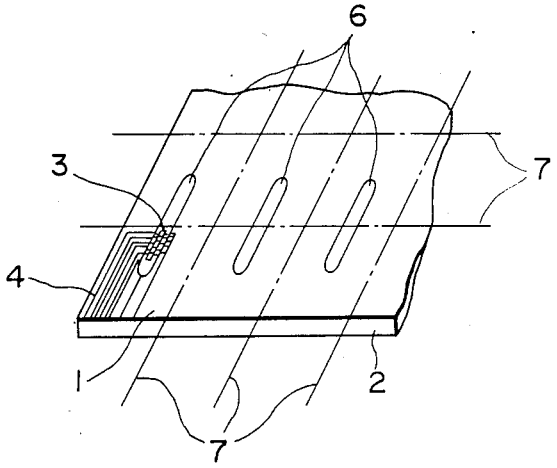
FIG. 3 PRIOR ART
FIG. 3 illustrates a prior art manufacturing method.
Figure 4:
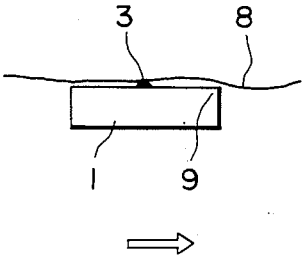
FIG. 4 PRIOR ART
FIGS. 4 and 5 illustrate a drawback in the prior art.
Figure 5:
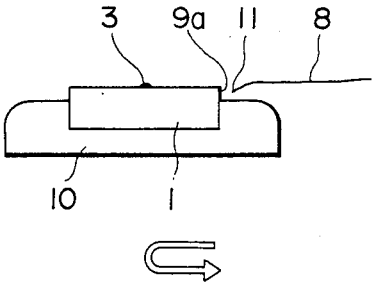
FIG. 5 PRIOR ART
Figure 6:
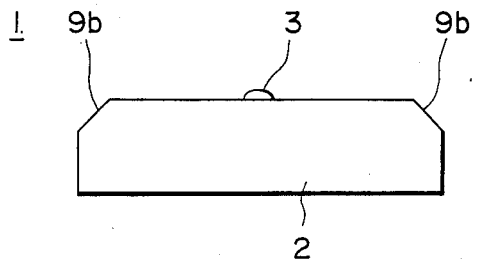
Figure 7:
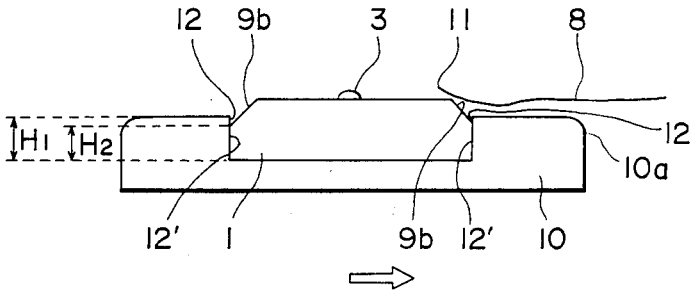

FIGS. 6 and 7 show a first embodiment of the present invention. In the present embodiment, bevels 9*b* are formed at edges of a substrate 2 of a thermal head 1.

As shown in FIG. 7, bevels 10*a* are also formed at edges of a heat sink 10 facing a record paper 8. A recess 12 is formed between the heat sink 10 and the thermal head 1. A depth $H_1$ of the recess 12 is larger than a height $H_2$ of a side 12' of the thermal head 1.

In the present embodiment, in whatever position the thermal head 1 assumes, a side edge 11 of the record paper 8 contacts the bevel 9*b* formed at the edge of the substrate 2 and is guided to the surface of the thermal head. Accordingly, the record paper 8 is not jammed or scratched by the edge of the thermal head 1.

The same is true for an ink ribbon.

Second Embodiment

Figure 8:
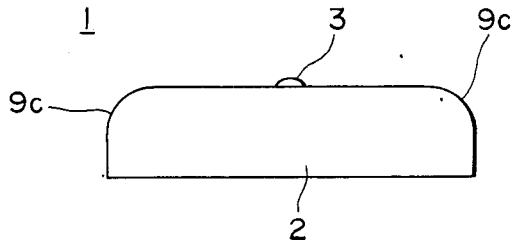
FIG. 8 is a plan view of another embodiment of the present invention.

FIG. 8 shows a second embodiment of the present invention. In the present embodiment, arcuate bevels 9*c* are formed at edges of the substrate 2.

In the present embodiment, the side edge 11 of the record paper 8 is guided to the surface of the thermal head 1 along the arcuate bevel 9*c*, as in the first embodiment.

Accordingly, the record paper or the ink ribbon is not jammed or scratched.

Figure 9:
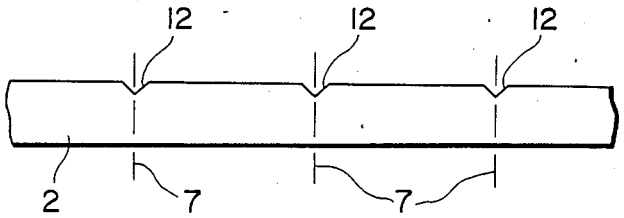
FIGS. 9–12 show other embodiments of the present method.
Figure 10:
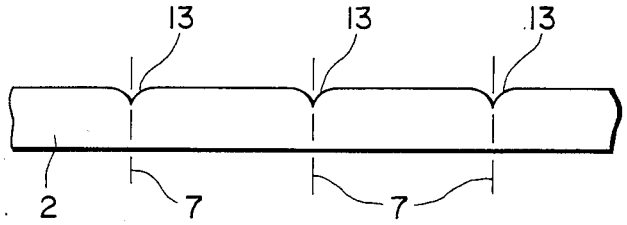

Manufacturing methods of the thermal heads described above are explained below. First Embodiment FIG. 9 shows a first embodiment of the present manufacturing method. In the present embodiment, V-shaped grooves 12 are formed along cut lines 7 on a bulk ceramic substrate 2. By cutting the substrate along the bottoms of the grooves 12, thermal heads 1 having oblique bevels 9*b* as shown in FIG. 6 are formed. Second Embodiment FIG. 10 shows a second embodiment of the present manufacturing method. In the present embodiment, arcuate grooves 13 are formed at positions facing the cut lines 7 on the substrate 2, and the substrate 2 is cut along the bottoms of grooves 13 to form the thermal heads having the arcuate bevels as shown in FIG. 8.

By forming the grooves 12 and 13 as shown in FIGS. 9 and 10, the cut areas can be reduced and the cut process is simplified.

Since the grooves 12 and 13 on the ceramic substrate 2 can be formed by using a mold, the number of steps does not increase.

Third Embodiment

Figure 11:
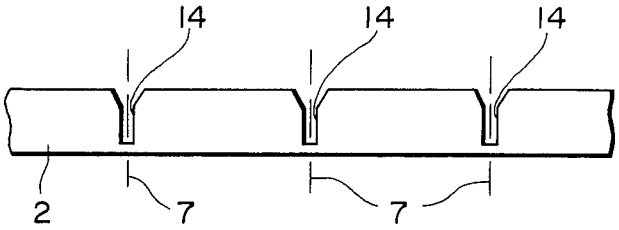

FIG. 11 shows a third embodiment of the present manufacturing method. In the present embodiment, deep grooves 14 having bevels are formed along the cut lines 7.

Because of the deep grooves 14, the cut areas are extremely small so that the cutting of the substrate 2 does not require a cutting machine such as a laser cutter but only requires simple cutting means such as pressing, or even manual cutting.

Fourth Embodiment

Figure 12:
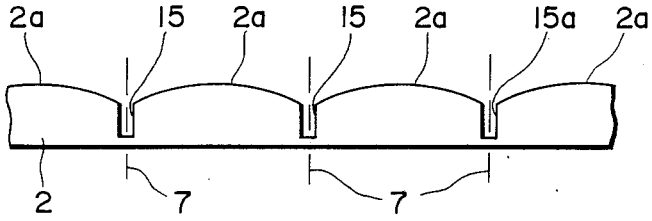

FIG. 12 shows a fourth embodiment of the present manufacturing method. In the present embodiment, arcuate surfaces 2*a* are formed on the substrate 2 and deep grooves 15 are formed along the cut lines 7. Thus, the cutting process is significantly simplified as in the embodiment of FIG. 11 and the finished thermal heads have tapered arcuate surfaces. Accordingly, the record paper or the ink ribbon is not jammed or scratched.

As described hereinabove, according to the present invention, the bevels are formed at the edges of the substrate of the thermal head so that it exhibits good contact to the record paper or the ink ribbon and print quality is improved.

In addition, since the bevelled grooves are formed along the bulk substrate before it is cut into individual thermal heads, no machining for the bevels is required and the cutting process is highly simplified.

What I claim is:

1. A thermal head blank comprising;

electrode means;

heat generating means connected to said electrode means; and a plurality of rectangular support means for supporting said heat generating means, wherein edges of saisd support means are beveled and grooved to provide a plurality of thermal heads with beveled edges by severing the blank at said grooves.

2. A thermal head blank according to claim 1, wherein said beveled edges are normal to a direction of movement of said thermal head.

3. A thermal head blank according to claim 1, wherein said support means is ceramic.

4. A thermal head blank according to claim 1, wherein the surfaces of said beveled edges are planar.

5. A thermal head blank according to claim 1, wherein the surfaces of said beveled edges are curved.

6. A thermal head comprising:

heat generating means;

electrode means connected to said heat generating means;

first support means for supporting said heat generating means and said electrode means; and second support means having a recess deeper than a height of said first support means, wherein said first support means is received in said recess, the depth of which is dimensioned so that said heat generating means protrudes from said second support means for contact with a record paper.

7. A thermal head according to claim 6, wherein said first support means is ceramic.

8. A thermal head according to claim 6, wherein a side of said first support means for supporting said heat generating means and said electrode means is beveled.

9. A thermal head according to claim 8, wherein the surface of saids beveled edge is planar.

10. A thermal head according to claim 8, wherein the surface of said beveled edge is curved.

11. A thermal head according to claim 6, wherein said second support means has beveled edges.

12. A thermal head blank comprising;

electrode means;

heat genenrating means connected to said electrode means; and a plurality of rectangular support means for supporting said heat generating means, wherein edges of said support means have a radius of curvature and are grooved to provide a plurality of thermal heads with curved surfaces at the edges thereof by severing the blank at said grooves.

13. A thermal head blank according to claim 12, wherein said radius of curvature on said edges of said support means is normal to a direction of movement of said thermal head and forms a cylindrical wall having a center axis located closer to said support means than to said heat generating means.

14. A thermal head blank according to claim 12, wherein said support means is ceramic.

* * * * *

UNITED STATES PATENT AND TRADEMARK OFFICE

CERTIFICATE OF CORRECTION

PATENT NO. : 4,701,593

DATED : October 20, 1987

INVENTOR(S) : SOICHI HIRAMATSU

It is certified that error appears in the above-identified patent and that said Letters Patent is hereby corrected as shown below:

COLUMN 1

Line 20, "6 a" should read --6. A--.
Line 27, "resister" should read --resistor--.
Line 42, "second" should read --record--.

COLUMN 2

Line 9, "bevels of" should read --bevels at--.
Line 10, "other" should read --another--.
Line 21, "other" should read --another--.

COLUMN 3

Line 17, "First Embodiment" should be a heading between lines 17 and 18.
Line 21, "substrate along" should read --substrate 2 along--.
Lines 23-24, "Second Embodiment" should be a heading between lines 24 and 25.
Line 32, "cut" (second occurrence) should read --cutting--.

UNITED STATES PATENT AND TRADEMARK OFFICE

CERTIFICATE OF CORRECTION

PATENT NO. : 4,701,593

DATED : October 20, 1987

INVENTOR(S) : SOICHI HIRAMATSU

It is certified that error appears in the above-identified patent and that said Letters Patent is hereby corrected as shown below:

COLUMN 4

Line 10, "saisd" should read --said--.
Line 40, "saids" should read --said--.
Line 47, "genenrating" should read --generating--.

Signed and Sealed this

Third Day of May, 1988

*Attest:*

*Attesting Officer*

DONALD J. QUIGG

*Commissioner of Patents and Trademarks*